US007395774B2

(12) United States Patent
Borges et al.

(10) Patent No.: US 7,395,774 B2
(45) Date of Patent: Jul. 8, 2008

(54) RETRACTABLE BOAT SHADE CANOPY, FRAME AND MOUNTING SYSTEM ATTACHABLE TO A BOAT'S EXISTING T-TOP

(76) Inventors: Juan Alberto Borges, 16546 NE. 26 Ave., Apartment 6D, North Miami Beach, FL (US) 33160; Sean Paul Borges, 3130 SW. 62 Ct., Miami, FL (US) 33155; Victor Francis Borges, 3130 SW. 62 Ct., Miami, FL (US) 33155

( * ) Notice: Subject to any disclaimer, the term of this patent is extended or adjusted under 35 U.S.C. 154(b) by 0 days.

(21) Appl. No.: 11/445,855

(22) Filed: Jun. 3, 2006

(65) Prior Publication Data

US 2008/0022916 A1 Jan. 31, 2008

(51) Int. Cl.
*B63B 17/02* (2006.01)

(52) U.S. Cl. ..... 114/361

(58) Field of Classification Search ..... 114/361
See application file for complete search history.

(56) References Cited

U.S. PATENT DOCUMENTS 3,165,762 A * 1/1965 Hage ..... 114/361
2002/0043204 A1* 4/2002 Tomatsu ..... 114/361

* cited by examiner

*Primary Examiner*—Jesús D Sotelo
(74) *Attorney, Agent, or Firm*—William R. Trueba, Jr.

(57) ABSTRACT

The present invention relates to a retractable canopy structure adapted to be used in conjunction with the canopy structure on a boat's existing T-top tubular frame near the level of the existing canopy. The canopy frame structure comprises two longitudinally aligned, telescoping members with at least one transverse, telescoping frame member disposed between the two longitudinal members to prevent the canopy from collapsing when under tension. The canopy frame structure is disposed onto the existing T-top frame using a mounting assembly comprising of a grommet adapted to be placed between two frame members and wrapped with an adjustable strap. The canopy and telescoping frame components are designed to be adaptable to various T-top canopy widths, and can be extended to various lengths to increase the amount of available canopy shade area while in the mounted position on the boat's existing T-top.

14 Claims, 3 Drawing Sheets

RETRACTABLE BOAT SHADE CANOPY, FRAME AND MOUNTING SYSTEM ATTACHABLE TO A BOAT'S EXISTING T-TOP

The present invention relates to a retractable boat shade canopy, frame and mounting system that can be retrofit onto a boat's existing T-top structure.

BACKGROUND OF THE INVENTION

Open fishermen class boats are designed with a center console providing an open area layout around the deck offering its passengers limited obstructions for walking, fishing and participating in other activities while exposed to the sun. T-tops provide shade on a boat by way of a canopy attached to a structural, tubular frame affixed onto the deck of a boat. The canopy of existing T-tops only provide a limited amount of shade generally around the center console of the boat, mostly shading the driver of the boat while leaving others on the boat exposed to the sun.

Presently there are two methods for providing additional shade on a boat: Bimini tops and umbrella-like canopies with a main support and rigging lines. Bimini tops require permanently mounted brackets, additional hardware, tubular frames and a canopy that must be customized to the make, class and layout of the boat on which it will be installed. Although some Bimini tops are retractable, they usually have two positions. A fully open position providing shade, and a closed position. Bimini tops require the use of an elaborate frame and anchoring system that must be planned and permanently installed on the boat and requires drilling, cutting and permanently modifying the boat and the Bimini Top. Most Bimini tops restrict movement around some areas of the boat and are designed to be low-lying, making it difficult to stand erect under them. Additionally, such Bimini tops can also restrict one's vision.

Umbrella-like canopies provide adequate shade and are portable but are bulky and have a mounting system that compresses the main support by way of tensioned lines rigged to cleats or other existing hardware on the boat. This restricts the ability of movement and activities around the umbrella and its rigging. The umbrella canopy and rigging must be removed and stowed away prior to shoving off. There is a need for a light-weight, retractable boat shade canopy that does not restrict movement and that allows the passengers on the boat to stand erect and that does not restrict.

OBJECTS OF THE INVENTION

The following section of the written description describes some of the objects of the present invention, but the section is not exhaustive of all of invention's objects.

It is an object of the present invention to provide a retractable boat shade canopy that can be used to increase the shaded area of a boat.

It is a further object of the present invention to provide a retractable boat shade canopy that can be retrofit onto an existing T-top structure.

It is yet a further object of the invention to provide a light-weight retractable boat shade canopy that does not require tools, or destructive, permanent modifications to the existing mounting surfaces of the boat for its installation or removal.

It is another object of the present invention to provide a canopy and telescoping frame components that are adaptable to various T-top canopy widths and that can be extended to various lengths to increase the amount of available canopy shade area while in the mounted position on the boat's existing T-top.

It is a further object of the present invention to provide a retractable boat shade canopy and can be installed or detached in minutes, is portable and adaptable for mounting on most standard and commercially available T-top frames.

SUMMARY OF THE INVENTION

The present invention relates to a retractable canopy structure that is retrofit onto a boat's existing T-top tubular frame at approximately the level of the existing canopy. This structure is advantageous because it uses the existing tubular frame and requires no additional supports at the deck level.

BRIEF DESCRIPTION OF THE DRAWINGS

The subject matter which is regarded as the invention is particularly pointed out and distinctly claimed in the claims at the conclusion of the specification. The foregoing, and other objects, features, and advantages of the present invention are shown and described in the following detailed description of the preferred embodiments which should be viewed in conjunction with the accompanying drawings in which:

DETAILED DESCRIPTION OF THE PREFERRED EMBODIMENTS

Figure 1:
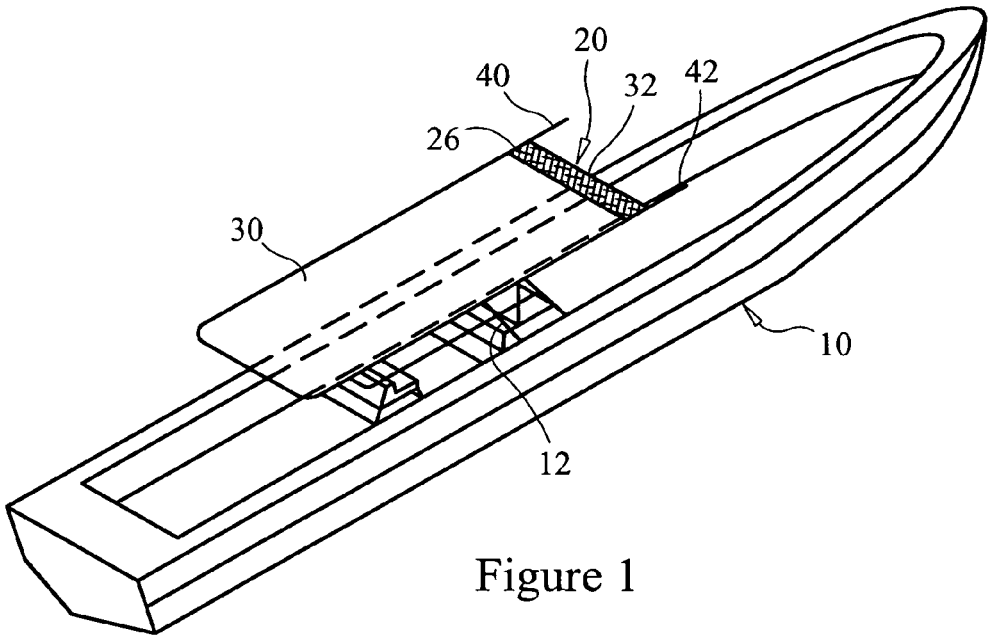
FIG. 1 illustrates a perspective view of a boat with an embodiment of the canopy support frame with no rigging in the retracted position mounted on an existing T-top.

The present invention relates to a light-weight, retractable canopy, frame and mounting system that can be attached to a boat's existing T-top or other deck-mounted frame. The invention includes a mountable, non-permanent, hand-tightened, no-slip fastener component that does not require tools or modification to the existing mounting surface for its installation or removal. The present invention also includes a canopy and frame work components which can be extended or retracted to various lengths while in a fix-mounted width position that can extend parallel to the existing T-top plane, and is detachable, portable and adaptable for mounting on most standard and commercially available T-top frames. In general, statements made in the specification do not limit any of the various claimed inventions. Moreover, some statements may apply to some inventive features but not to others. Unless otherwise indicated, singular elements may be in the plural and vice versa with no loss of generality. Similar reference numerals and letters represent similar components and system features throughout the drawings and the written description.

Figure 2:
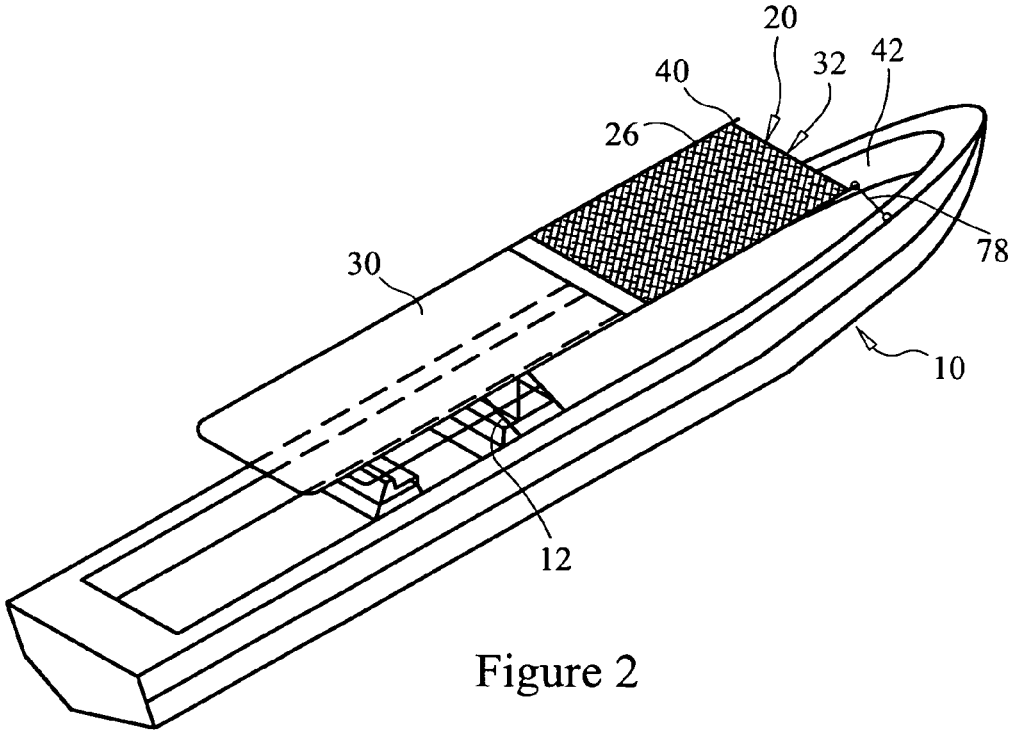
FIG. 2 illustrates a perspective view of a boat having a T-top with a canopy support frame with rigging in the extended position mounted to the existing T-top.
Figure 4:
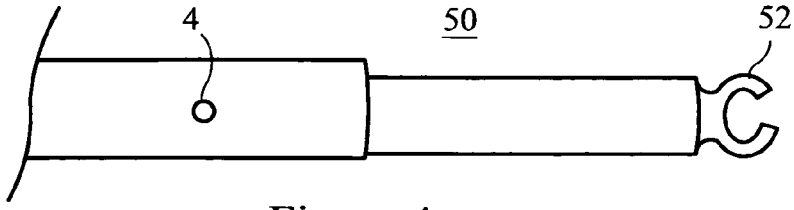
FIG. 4 illustrates a side view of a telescoping transverse member.
Figure 8:
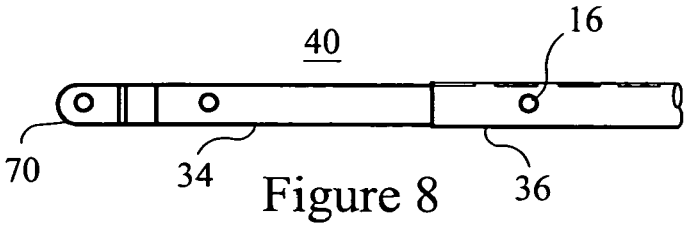

FIG. 1 illustrates a perspective view of a boat 10 with an embodiment of the boat shade canopy unit 20 of the present invention in the retracted position mounted on an existing T-top 30. In the embodiment illustrated in FIGS. 1 and 2, the canopy support frame components consist of three tubular telescoping members 40, 42, 50 (and associated hardware), each consisting of at least two tubular sections of differing diameters allowing the lesser diameter tube the ability to be housed and slide into and out of the larger diameter tube. See FIGS. 4 and 8. A position-locking spring loaded pin system (not shown) is used to lock into position the tubular sections at the desired extended or retracted length. Locking pins 14, 16 housed within the smaller diameter tube protrudes through a hole having a diameter slightly larger than the pin diameter. See FIGS. 4 & 8.

In the illustrated embodiment, two of the three tubular telescoping members are designated for use as the retractable parallel telescoping support members 40, 42, which are fastened to the existing T-top frame 12 by the mounting component of this invention, to the existing boat T-Top structure 12 in a cantilever fashion, and on which the canopy fabric 26 is supported and laterally extended and retracted. The third tubular telescoping member 50 is designated as the transverse telescoping support guide member 50, and uses two connectors 54, 56 located at its end points (see FIGS. 3-5), to connect itself to the two parallel telescoping support members 40, 42 in a transverse (substantially perpendicular) position. The dual role of the transverse support guide member 50 is to maintain the width spacing of the retractable parallel telescoping support members 40, 42 at the non-supported end, and provide points of support when tension is applied to the canopy fabric 26. The clamp-like connectors 54, 56 (FIG. 3) allow the transverse telescoping support guide member 50 to slide along the retractable parallel telescoping support members 40, 42 (when the canopy tension is relaxed, or vise versa, so that the desired location of the transverse member 50 can be achieved, or so the canopy 26 and/or the parallel telescoping support members 40, 42 can be extended or retracted.

The forward or distal end 44, 46 of each of the parallel telescoping support members 40, 42 terminates with a forward end line tie-down fastener 70, 72. This fastener 70, 72 affords the forward end 44, 46 of the parallel telescoping support members 40, 42 with a method to tie down the non-supported end 32 of the canopy support frame component 20 against wind uplift. See tie line 78 in FIG. 2.

Figure 6:
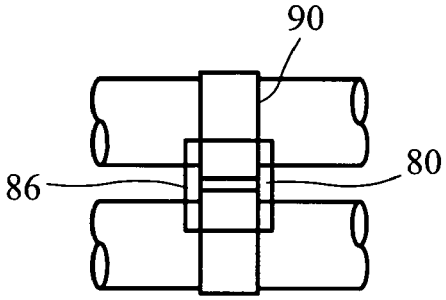
FIGS. 6 and 7A diagrammatically illustrate views of the mounting of the canopy unit's telescoping, tubular canopy support member adjacent the existing boat's tubular frame member.
Figure 7A:
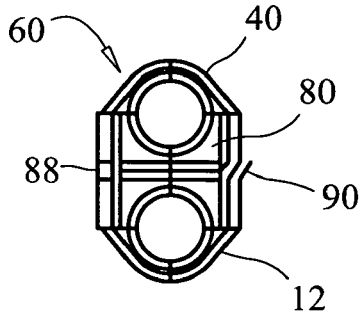
Figure 7B:
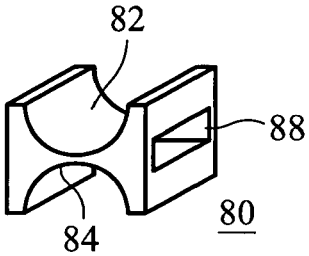
FIG. 7B illustrates a perspective view of the mounting grommet of FIG. 7A.
Figure 9:
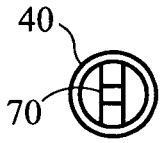
FIGS. 8 and 9 diagrammatically illustrate side and cross-sectional views of the end of the telescoping support members.

The mounting component 60 of this invention 20 involves the use of a grommet 80 and Velcro®-type fastener 90 which allows the parallel alignment and fastening, with minimal parallel separation, of two sections of tubular frame. See FIGS. 6, 7A and 7B. Both sections of the tubular frame are independently attached to the no-slip grommet 80, which in the preferred embodiment is made of nylon, rubber, silicone, plastic, wood, or similar vibration-absorbing material. The grommet's semicircular notches 82, 84 on each side of the rectangular piece (see FIG. 7B) are shaped to be disposed on the tubular frame members of the present invention and the existing T-top. In the preferred embodiment, the grommet 80 also includes a passageway 88 that traverses the grommet to provide an additional means of securing the present invention onto the existing frame member of the boat. The tubular frame members 40, 12 are held to the grommet by hand-tightening the strap 90 that overlaps the exposed section of rubber to the metal (FIG. 7A). The strap 90 is typically a flexible material that includes a fabric of small hooks that sticks to a corresponding fabric of small loops on another part of the strap that permits the strap to be fastened tightly so as to not permit slippage of the tubular frame members. In one embodiment, one end of the strap 90 is attached to a buckle 86. See FIG. 6. The other end of strap 90 is passed through passageway 88 of grommet 80 such that the buckle 86 abuts one face of the grommet. The strap 90 is then wrapped around the pre-existing tubular frame 12 of the boat and the tubular frame member 40, 42 of the present invention to secure the retractable boat shade canopy. This fastening device 60 creates a non-permanent, hand-tightened, no-slip fastener component which does not require tools or modification to the mounting surface for its mounting or removal of the canopy support to the existing T-Top frame or canopy.

Figure 3:
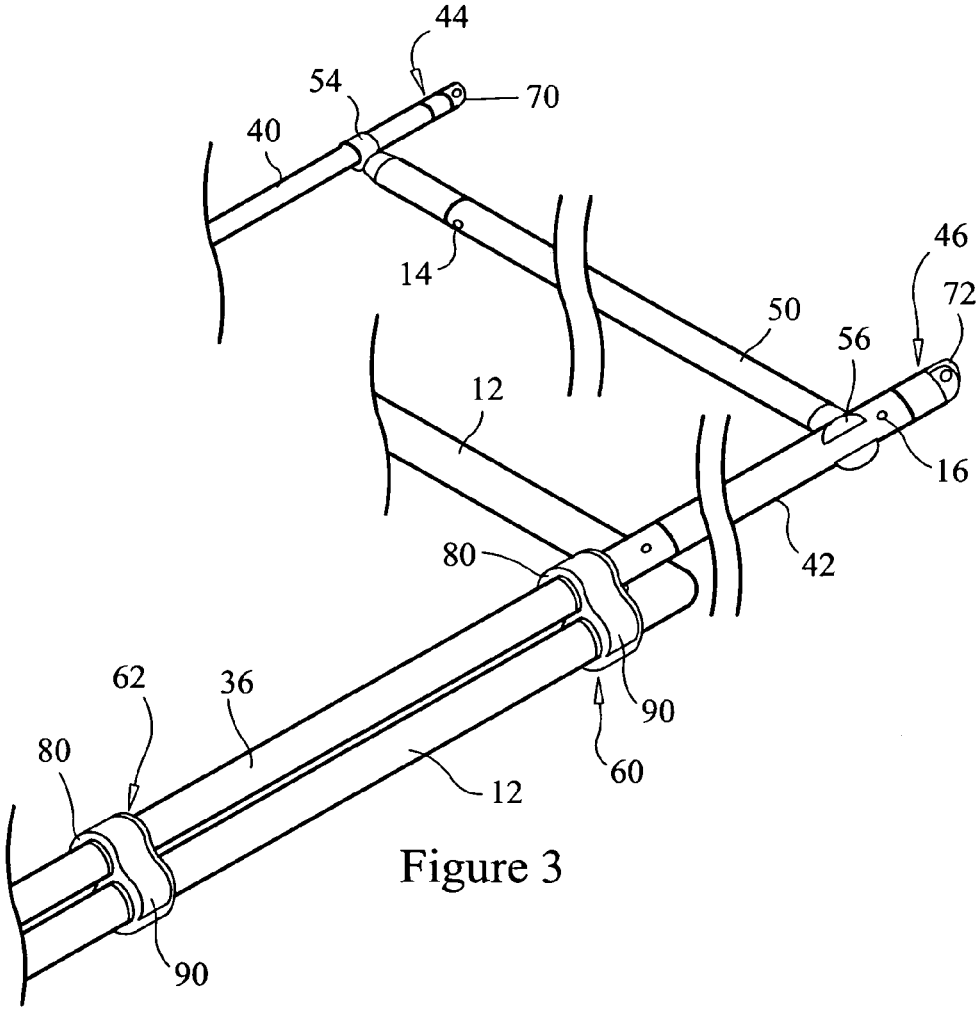
FIG. 3 diagrammatically illustrates a perspective view of the canopy support frame atop an existing T-top frame.

In the preferred embodiment, the invention utilizes four mounting components 60 to fasten the canopy support frame components 40, 42 to the existing T-top frame 12 in a cantilever fashion. Typically, this is accomplished by placing two of the fasteners 60, 62 on each of the telescoping tubular canopy support's larger diameter tubing 36 at predetermined, off-centered fastener spacing, rendering each piece of tubing stationary and parallel to the existing T-top frame 12 (FIG. 3). This allows the extension and retraction of the smaller diameter tubing section within it. This series of steps are repeated for the parallel (second) canopy support frame member 40 to be fastened to the existing T-top frame's parallel member in order to obtain a canopy support frame capable of extending and retracting a parallel canopy plane 26 in the desired direction, relative to the existing boat's T-top canopy.

In the preferred embodiment, the canopy shade component 26 consists of a sewn rectangular piece of canopy (or fabric material) capable of providing shade and rain protection with grommets equally spaced and of equal quantity along each of the two lateral and opposite edges of the canopy, commencing and terminating at the four corners. Additional components to secure the canopy 26 to the tubular frame include lines and fasteners of sufficient length and quantity to be used as rigging to produce tension on the canopy when the canopy is properly positioned and rigged on the canopy support frame.

The canopy (or fabric material) 26 shall be of sufficient length (laterally) to be capable of being extended from the existing T-top to the end of the two fully extended parallel telescoping support members 40, 42. Preferably, the canopy (or fabric material) 26 shall be of sufficient width (transverse section) to be positioned along the top of one parallel telescoping support member 40 to the top of the other 42 with a sufficient amount of material to overlap each parallel telescoping support member 40, 42 when the canopy is centered.

Figure 5:
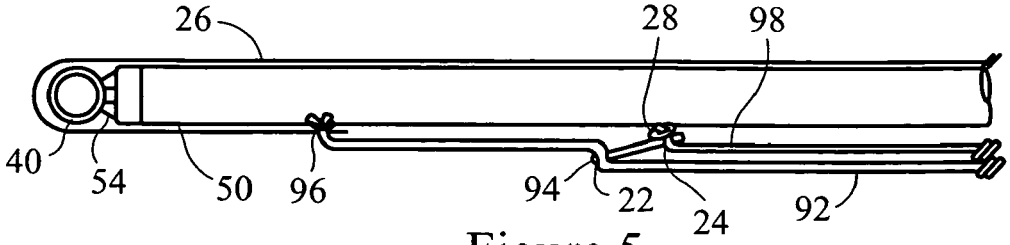
FIG. 5 illustrates a side view of the canopy and support frame rigging.

FIG. 5 illustrates a side view of the canopy 26 and support frame rigging. The overlapped material 26 will be wrapped 180 degrees downward along the outer edges of the parallel telescoping support members 40, 42 and rigged with the line 92 and fastener 94 perpendicular to the parallel telescoping support members 40, 42, from a grommet 96 on one parallel edge of the canopy 26, to the corresponding grommet (not shown) on the other parallel edge of the canopy. In the preferred embodiment, the canopy 26 is rigged by attaching the line 92 of sufficient length to the grommet 96 at one lateral canopy edge with a no-slip knot and the line passed through the corresponding, opposite canopy edge's grommet (not shown). In one embodiment, the line 92 is looped back towards the first grommet a maximum length of twenty four inches. Tension is applied to the line 92 and canopy 26 by sliding the end of the looped line 98 towards the end of the line affixed to the grommet. Both the looped end 98 and its parallel segment of line pass through two separate holes 22, 24 of equal size on the fastener 94. On the opposite end of the fastener 94, the looped line segment terminates in a knot 28 of sufficient size to disallow the line from coming out of the hole. Both holes are of sufficient size to allow their corresponding segments of line 98, 92 to slide through their corresponding holes 24, 22 when the fastener 94 is in a perpendicular position to the two parallel line segments. Tension is placed on the line and canopy when the fastener 94 is hand positioned by sliding it towards the grommet 96 with the affixed line end, and locked in place when the tension in the line is held and the fastener 94 is allowed to rotate relative to the parallel lines, creating a non-slip friction lock on the line. To release the tension, the fastener 94 is rotated perpendicular to the line segments, and slid in the opposite direction until the desired amount of tension is released from the line.

It is important to note that the embodiments of the invention described below are only examples of some of the uses of the teachings described herein. In general, statements made in the specification do not limit any of the various claimed inventions. Moreover, some statements may apply to some inventive features but not to others. Unless otherwise indicated, singular elements may be in the plural and vice versa with no loss of generality. Similar reference numerals and letters represent similar components and system features throughout the drawings and the written description.

The claims appended hereto are meant to cover modifications and changes within scope and spirit of the present invention.

What is claimed is:

1. A boat shade canopy unit for a boat having a T-top frame comprising:

a mounting system, a canopy and a tubular canopy support frame adapted to be disposed on the boat's T-top frame at said T-top's vertical elevation in a cantilevered fashion, said tubular canopy support frame including two cantilevered telescoping tubular shade supports and a telescoping tubular transverse support guide member disposed between said tubular shade supports;

said mounting system comprising at least two Velcro and grommet assemblies used to secure a part of said canopy support frame to the boat's T-top frame; and said canopy and said canopy support frame being capable of extending or retracting to various lengths while said mounting system is affixed to said T-top frame, and said canopy and said canopy support frame telescoping to a width substantially similar to the width of said T-top frame.

2. A boat shade canopy unit as claimed in claim 1 wherein said telescoping tubular transverse support guide member is disposed between said two cantilevered telescoping tubular shade supports at a non-supported end of said canopy support frame to maintain a width separation between said two cantilevered telescoping tubular shade supports, said transverse support guide member providing support for tensioning of said canopy.

3. A boat shade canopy unit as claimed in claim 1 further comprising at least one tie-down fastener attached to a forward end of one of said cantilevered telescoping tubular shade supports, said tie-down fastener adapted to secure said boat shade canopy unit relative to the boat.

4. A boat shade canopy unit as claimed in claim 1 wherein said canopy includes sufficient material to be supported and disposed to said support frame by wrapping ends of said canopy around the support frame and applying tension to said canopy by using a line weaved through said ends of said canopy and securing the line in place with a fastener.

5. A boat shade canopy unit as claimed in claim 1 wherein each of said at least two Velcro and grommet assemblies further comprises a buckle attached to a strap having said Velcro disposed thereon and wherein said grommet includes a slot adapted to receive said strap and wherein said grommet includes surfaces shaped to adapt to surfaces of said canopy support frame and the boat's T-top frame.

6. A boat shade canopy unit for a boat having a tubular frame disposed atop the boat comprising:

a canopy support frame adapted to be disposed on the boat's tubular frame in a cantilevered fashion, said canopy support frame including two substantially parallel telescoping shade support members and a telescoping transverse support guide member disposed between said shade support members;

a mounting system comprising at least two assemblies, each said assembly used to secure a respective part of said shade support members of said canopy support frame to a corresponding section of the boat's tubular frame, each said assembly comprising a grommet adapted to be placed between said respective part of said shade support member and said corresponding section of the boat's tubular frame, and a strap adapted to wrap around said section of the boat's tubular frame and said part of said shade support members such that said grommet is held in place snugly;

a canopy disposed on said canopy support frame such that said canopy support frame can be extended such that at least a portion of said canopy extends outward from the boat's tubular frame.

7. A boat shade canopy unit as claimed in claim 6 wherein said telescoping transverse support guide member is disposed between said two telescoping shade support members at a non-supported end of said canopy support frame to maintain a width separation between said two telescoping shade support members, said transverse support guide member providing support for tensioning of said canopy.

8. A boat shade canopy unit as claimed in claim 6 further comprising at least one tie-down fastener attached to a forward end of one of said telescoping shade support members, said tie-down fastener adapted to secure said boat shade canopy unit relative to the boat.

9. A boat shade canopy unit as claimed in claim 8 wherein said mounting system further comprises at least one line coupled at one end to said at least one tie-down fastener and said other end of said line adapted to be coupled to the boat.

10. A boat shade canopy unit as claimed in claim 6 wherein said canopy includes sufficient material to be supported and disposed onto said support frame by wrapping ends of said canopy around the members of said support frame and applying tension to said canopy by using a line weaved through said ends of said canopy and securing the line in place with a fastener.

11. A boat shade canopy unit as claimed in claim 6 wherein said two telescoping shade support members and said telescoping transverse support guide member are tubular members.

12. A boat shade canopy unit as claimed in claim 6 further comprising a buckle attached to said strap; wherein said grommet includes a slot adapted to receive said strap and wherein said grommet includes surfaces shaped to adapt to the surfaces of said respective part of said shade support member and said corresponding section of the boat's tubular frame.

13. A retrofit boat shade canopy unit for a boat having a tubular frame with at least two substantially parallel frame members disposed atop the boat, the retrofit boat shade canopy unit comprising:

a canopy support frame adapted to be disposed adjacent the boat's tubular frame, said canopy support frame including two substantially parallel telescoping support members and a telescoping transverse compression member disposed between said shade support members to space apart said support members such that said support members substantially align with corresponding parallel frame members of the boat's tubular frame;

at least two mounting assemblies, each said assembly used to secure a respective part of said support members of said canopy support frame to a corresponding section of the parallel frame members of the boat's tubular frame, each said assembly comprising a grommet adapted to be placed between said respective part of said support members and said corresponding section of the parallel frame members of the boat's tubular frame, and a strap adapted to wrap around said section of the boat's tubular frame and said part of said support members such that said grommet is held in place snugly;

a canopy disposed on said canopy support frame such that said canopy support frame can be extended such that at least a portion of said canopy extends outward from the boat's tubular frame.

14. A boat shade canopy unit as claimed in claim 13 further comprising a buckle attached to each said strap; wherein each said grommet includes a slot adapted to receive said strap and wherein said grommet includes surfaces shaped to adapt to the surfaces of said respective part of said support members and said corresponding section of the boat's tubular frame.

* * * * *